United States Patent [19]

Lacasse

[11] 4,358,916

[45] Nov. 16, 1982

[54] NOVEL CORRUGATED METAL BUILDING STRUCTURAL UNIT

[76] Inventor: Maurice Lacasse, c/o 1191 Chemin Industriel, Bernieres, Cte Levis, Quebec, Canada, G0S 1C0

[21] Appl. No.: 154,017

[22] Filed: May 28, 1980

[30] Foreign Application Priority Data

Feb. 7, 1980 [CA] Canada ..... 345222

[51] Int. Cl.[3] ..... E04C 2/32

[52] U.S. Cl. ..... 52/630; 52/537

[58] Field of Search ..... 52/630, 537, 450

[56] References Cited

U.S. PATENT DOCUMENTS

| | | | |
|---|---|---|---|
| 2,417,899 | 3/1947 | Ashman | 52/537 X |
| 3,520,100 | 7/1970 | Webb | 52/630 X |
| 3,760,549 | 9/1973 | Silberkuhl et al. | 52/630 |
| 4,144,369 | 3/1979 | Wass | 52/450 X |

FOREIGN PATENT DOCUMENTS

| | | | |
|---|---|---|---|
| 978322 | 11/1975 | Canada | 52/630 |
| 1330005 | 9/1973 | United Kingdom | 52/573 |

*Primary Examiner*—Carl D. Friedman

*Attorney, Agent, or Firm*—Birch, Stewart, Kolasch & Birch

[57] ABSTRACT

A corrugated metal building panel (e.g., made of steel) is provided herein. The panel has at least one (and preferably two) longitudinally extending major waves disposed about a neutral axis. Each such major wave is provided with a plurality of spaced-apart, discontinuous, web zones, each web zone comprising a plurality of interlinked longitudinally extending wave-like stiffeners superposed thereon. The wave-like stiffeners follow the general major corrugated pattern of the major wave thereof. A plurality of spaced-apart flange zones are formed on the panel, the flange zones comprising spaced-apart flattened areas deformed from the general corrugated pattern of the general major corrugated pattern of the panel. The panel is also provided with spaced-apart flange stiffeners. Furthermore, such flange stiffeners which are distributed along the major wave, always project from the exterior of the curvature of the major wave and are always directed towards the neutral axis of the panel. In this way, the local buckling factor is improved and the section modulus is increased, with the degree of improvement in local buckling factor and section modulus being optimized by the selection of a particular configuration from a series of alternative configurations. Thus, the strength and rigidity of the corrugated panel is increased.

19 Claims, 21 Drawing Figures

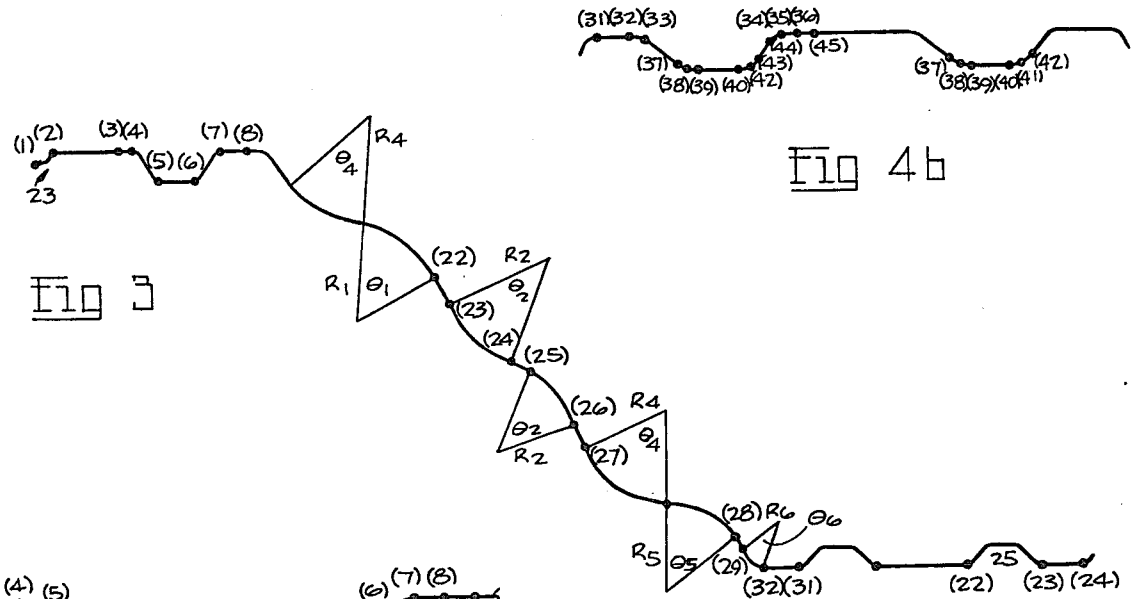
Fig 4b
Fig 3
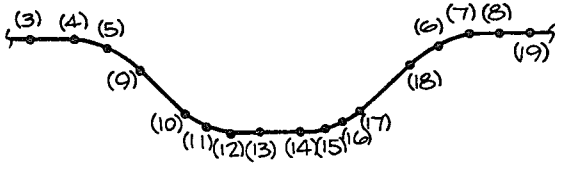
Fig 4a

NOVEL CORRUGATED METAL BUILDING STRUCTURAL UNIT

BACKGROUND OF THE INVENTION (i) Field of the Invention

This invention relates to novel corrugated metal, e.g., steel, structural building panels. It is directed especially to those panels which, when assembled together, can provide a self-supporting, frameless building structure, preferably one in which the truss in hidden in the attic disposed between a ceiling of the building structure and its roof, and a "wide-span" roof, i.e., one which can have a wide span between supports.

(ii) Description of the Prior Art

In roofs having a wide span between supports, it is highly important that great rigidity and strength be provided in the building panels. It was thought that corrugated steel panels would be suitable for such purpose, but, in practice, it was found that such panels generally were not sufficiently rigid for the building of a "wide-span" roof. Moreover, the absence of a frame gave rise to other problems in proper designing of the roof panels.

A number of prior patents disclose complexly configured corrugated panels in an attempt to provide panels having great rigidity and strength. U.S. Design Pats. to Haman et al. No. 164,990 and Haman et al. No. 165,978 show the use of minor corrugations in valleys between major corrugations.

U.S. Design Pat. to Hield No. 178,605 shows the use of minor corrugations having cascades thereon in a valley between major corrugations.

Beech U.S. Pat. No. 2,585 also shows a corrugated metal panel with minor corrugations in the valleys between the major corrugations.

Sagendorph U.S. Pat. No. 362,118 shows a corrugated metal panel having a single minor corrugation on the major corrugations.

Sisson U.S. Pat. No. 1,800,363 shows (in FIG. 11) minor breaks in the hills and valleys of a corrugated panel.

Overholtz U.S. Pat. No. 2,073,706 shows minor corrugations in the valley between major corrugations having a minor corrugation thereon in a metal panel.

Ashman U.S. Pat. No. 2,417,899 shows a corrugated sheet having a minor corrugation in valleys between major corrugations, the major corrugations themselves having a minor corrugation thereon.

These panel constructions, as taught by the above-noted prior patents, however, have not been used and are not usable (indeed, they were not designed for use) for, or in, wide-span building constructions wherein the roof and wall panels are substantially self-supporting in mutual interconnection, i.e., for "wide-span" roof constructions.

One manner of attempting to solve such problem of providing panels for use in "wide-span" roof construction was suggested by Hermann in U.S. Pat. No. 2,812,730 patented Nov. 12, 1957. In that patent, building sheets were essentially elongated rectangular metallic sheets having an integrally formed bracing element in the form of a "V" along one edge of the sheet. The "V"-brace extended the full length of the sheet. It was suggested by Hermann that flat areas could be provided in these corrugations to give an even greater locking effect than would be achieved with overall curved or sine wave corrugations.

Another proposal was made by Behlen, in U.S. Pat. No. 3,064,771 patented Nov. 20, 1962, who provided a large span building covering unit in which deeply-formed or channel-ridged light gauge sheets were fastened together to form a unitary sheet metal plate to replace the upper chord of the conventional truss. Such structural units as taught by Behlen in this patent were said to provide structural building units of greater strength proportional to their weight than conventional construction and were said to be adapted to eliminate much of the dead-load of conventional construction, and were also said to be particularly adapted to eliminate parts used in conventional construction without eliminating the strength advantages of such parts.

Yet another proposal was suggested by Behlen, in U.S. Pat. No. 3,300,923 patented Jan. 31, 1967, which provided corrugated metal building panels which were curved lengthwise, so that they could be used to form a frameless building needing no roof supporting beams. In this Behlen patent, it was suggested that the presence of smaller corrugations within the large ones could greatly increase the possibility of forming a panel of a given gauge and a given depth of large corrugation to a given radius of curvature without buckling. Such a panel as proposed by Behlen having small lengthwise continuous corrugations in the larger corrugations was taught to have the combined corrugations of sufficient depth, contour and number and also the material of the panel should be of such strength and thickness, that when the panel was subjected to a compression load beyond the elastic limit of the material of which it was made, the panel would compress more easily than it would buckle.

Another proposal was provided by Behlen, in U.S. Pat. No. 3,492,765 patented Feb. 3, 1970, who provided corrugated wall and roof panels which had major and minor corrugations formed therein. The major and minor corrugations of the roof panels were in alignment with the major and minor corrugations in the wall panels.

A further proposal was provided by Cooper et al., in U.S. Pat. No. 3,308,596 patented Mar. 14, 1967, who provided a building wall and roof panel construction utilizing both major and minor corrugations, the panel having a symmetrical pattern of corrugations and permitting panel edge lap in such fashion that the panel assembly corrugation pattern was symmetric. The panel had both major and minor corrugations, the minor corrugations being continuous and being positioned on the major corrugations, the panel also optionally being fluted for control and removal of panel "oil canning", (the oil canning being fenced in by the minor corrugations, then limited areas are fluted).

Lacasse, in Canadian Pat. No. 978,322 patented Nov. 25, 1975, provided a corrugated building panel comprising two longitudinally extending major corrugations, each such corrugation being provided with a plurality of spaced-apart minor longitudinally extending continuous corrugations superimposed on the major corrugations and following the general corrugated pattern of the panel. The troughs an crests of the corrugations were flattened. In this way, each panel was provided with one central flat portion and a flat lateral side at each edge of the panel. By such construction, the load bearing capacity of the panel member was said to be increased.

While the corrugated steel building panels having continuous minor corrugations superposed in major corrugations provided by Hermann, U.S. Pat. No. 2,812,730; Behlen, U.S. Pat. No. 3,064,771; Behlen, U.S. Pat. No. 3,300,923; Behlen, U.S. Pat. No. 3,492,765; Cooper, U.S. Pat. No. 3,308,596; and Lacasse, Canadian Pat. No. 978,322, were considerably stronger on a weight/weight basis than other corrugated panels, it was discovered that such panels were, nevertheless, subject to local buckling. Thus, it has been found that the corrugated steel building panel buckled within the minor corrugations, i.e., was subject to local buckling, when subjected to a load which was less than the theoretical maximum load which it should support on the basis of the weight of steel used. Thus, the local buckling factor (Q) (a measure of the degree to which the strength approaches the theoretical maximum) was as follows for a panel based on that taught in the Lacasse Canadian patent:

TABLE I

| Gauge | Q |
|---|---|
| 22 | 0.62 |
| 20 | 0.63 |
| 18 | 0.74 |
| 16 | 0.81 |
| 14 | 0.87 |

In order for the minor corrugations on the major corrugation to provide a maximum strength improvement, the local buckling factor (Q) should approach 1.0. It will be seen from this table that Q ranged from 87% maximum (for thick steel) to 63% maximum (for thin steel).

SUMMARY OF THE INVENTION

(i) Aims of the Invention

Accordingly, it is one object of this invention to provide a corrugated steel building panel of the nature described above, namely, having minor corrugations superposed on major corrugations in which the local buckling factor is increased.

Another object of this invention is to provide a corrugated steel building panel of the nature described above, having an increased section modulus and increased moment of inertia, i.e., increased strength and rigidity of the corrugated panel to withstand perpendicular and vertical loads to the panel.

(ii) Statements of the Invention

The present invention is broadly embodied by a corrugated metal (e.g., steel) building panel having at least one longitudinally extending major wave disposed about a neutral axis, each such major wave being provided with a plurality of spaced-apart, discontinuous web zones, each web zone comprising a plurality of spaced-apart, discontinuous web zones, each web zone comprising a plurality of interlinked longitudinally extending wave-like stiffeners superposed on each major wave and following the general corrugated pattern of the major wave thereof, and a plurality of spaced-apart flange zones, the flange zones comprising spaced-apart flattened areas deformed from the general corrugated pattern of the major wave of the panel and spaced-apart semi-circular flange stiffeners, the semi-circular stiffeners projecting from the exterior of the curvature of the major wave and always being directed towards the neutral axis of the panel, whereby the local buckling factor is optimized, the section modulus and the moment of inertia are increased, and consequently the strength and rigidity of the panel is increased.

In a first preferred embodiment of this invention, a corrugated metal building panel is provided having two interlinked longitudinally extending major waves, disposed about a neutral axis, each such major wave being provided with a plurality of spaced-apart, discontinuous web zones, each web zone comprising a plurality of interlinked longitudinally extending wave-like stiffeners superposed on each major wave and following the general corrugated pattern of the major wave thereof, and a plurality of spaced-apart flange zones, the flange zones comprising spaced-apart flattened areas interconnected curved portions superposed on each major wave, the flattened areas being deformed from the general corrugated pattern of the major wave of the panel and spaced-apart semi-circular flange stiffeners, the semi-circular stiffeners projecting from the exterior of the curvature of the major waves and always being directed towards the neutral axis of the panel whereby the local buckling factor is optimized, and the section modulus and the moment of inertia are increased, and consequently the strength and rigidity of the panel is increased.

By a second preferred embodiment of this invention, a corrugated metal building panel is provided having two interlinked longitudinally extending major waves, disposed about a neutral axis, each such major wave being provided with a plurality of spaced-apart, discontinuous web zones, each web zone comprising a plurality of interlinked longitudinally extending wave-like stiffeners superposed on each major wave and following the general corrugated pattern of the major wave thereof, and a plurality of spaced-apart flange zones, the flange zones comprising spaced-apart discontinuous, longitudinally extending minor corrugations superposed on the major waves, and interconnected by flattened portions, the flattened areas being deformed from the general corrugated pattern of the major wave of the panel and spaced-apart semi-circular flange stiffeners, the semi-circular stiffeners projecting from the exterior of the curvature of the major waves, and always being directed towards the neutral axis of the panel whereby the local buckling factor is optimized, and the section modulus and the moment of inertia are increased, and consequently the strength and rigidity of the panel is increased.

By a third preferred embodiment of this invention, a corrugated metal building panel is provided having a single longitudinally extending major wave, the disposed about a neutral axis, such major wave being provided with a plurality of spaced-apart, discontinuous web zones, each web zone comprising a plurality of interlinked longitudinally extending wave-like stiffeners superposed on such major wave and following the general corrugated pattern of the major wave thereof, and a plurality of spaced-apart flange zones, the flange zones comprising spaced-apart discontinuous, longitudinally extending minor corrugations superposed on the major wave, and interconnected by flattened portions, the flattened areas being deformed from the general corrugated pattern of the major wave of the panel, and spaced-apart semi-circular flange stiffeners, the semi-circular stiffeners projecting from the exterior of the curvature of the major wave, and always being directed towards the neutral axis of the panel whereby the local buckling factor is optimized, and the section modulus and the moment of inertia are increased, and consequently the strength and rigidity of the panel is increased.

By a fourth preferred embodiment of this invention, a corrugated metal building panel is provided having three interlinked longitudinally extending major waves, disposed about a neutral axis, each such major wave being provided with a plurality of interlinked longitudinally extending wave-like stiffeners superposed on each major wave and following the general corrugated pattern of the major wave thereof, and a plurality of spaced-apart flange zones, the flange zones comprising spaced-apart flat areas interconnecting trapezoidally-shaped portions superposed on each major wave, the flattened areas being deformed from the general corrugated pattern of the major wave of the panel and spaced-apart trapezoidal flange stiffeners, the trapezoidal stiffeners projecting from the exterior of the curvature of the major waves and always being directed towards the neutral axis of the panel whereby the local buckling factor is optimized, and the section modulus and the moment of inertia are increased, and consequently the strength and rigidity of the panel is increased.

(iii) Other Features of the Invention

By one variant of the first preferred embodiment of this invention, the flange zones comprise a pair of spaced-apart semi-circular stiffener elements separated by flattened stiffener elements at the troughs and the crests of the major waves.

By a variation thereof, the flange zones also include seam stiffeners comprising a semi-circular stiffener element adjacent each lateral edge of the panel.

By a further variant of the first preferred embodiment of this invention, the lateral edges are flattened.

By a variation thereof, the flattened stiffener elements are longer at the troughs and at the crests than along the lateral edges of the major waves.

By another variant of the second preferred embodiment of this invention, the flange zones comprise a pair of spaced-apart, generally semi-circular stiffener elements disposed separated by flattened stiffener elements and on either side of, the troughs and the crests of the major waves.

By a variation thereof, the flange zones also include seam stiffeners comprising a generally semi-circular rear stiffener element adjacent each lateral edge of the panel.

By a further variant of the second preferred embodiment of this invention, the lateral edges are flattened.

By a variation thereof, the stiffener elements are longer at the troughs and at the crests than along the lateral edges of the major waves.

By another variant of the third preferred embodiment of this invention, the flange zones stiffeners comprise semi-circular stiffener elements disposed separated by flattened stiffener elements and on either side of, the troughs and the crests of the major waves.

By a further variant of the third preferred embodiment of this invention, the flange zones also include seam stiffeners comprising a generally semi-circular rear stiffener element adjacent each lateral edge of the panel.

By a variation thereof, the stiffener elements are longer in the portions interconnecting the minor corrugations than at the crest and the troughs.

By a variant of the fourth preferred embodiment of this invention, the flange zones include seam stiffeners comprising a trapezoidally-shaped seam element adjacent each lateral edge of the panel.

By a variation thereof, the lateral edges are flattened.

By another variant of the fourth preferred embodiment of this invention, the stiffener at each crest comprises three interlinked trapezoidally-shaped waves, and the stiffener at each of the troughs comprises a pair of interlinked trapezoidally-shaped waves.

BRIEF DESCRIPTION OF THE DRAWINGS

In the accompanying drawings,

FIG. 3 is a schematic transverse cross-section across one-half of a wave of the corrugated metal building panel of FIG. 1, depicting the generation of the profile thereof;

FIG. 4*a* is a schematic transverse section through a stiffener element near the lateral edge of the panel of FIG. 1, showing the generation of the profile thereof;

FIG. 4*b* is a schematic transverse cross-section through a "crest" or a "trough" stiffener element of the building panel of FIG. 1, showing the generation of the profile thereof;

DESCRIPTION OF PREFERRED EMBODIMENTS

(i) Description of FIGS. 1–4

Figure 1:
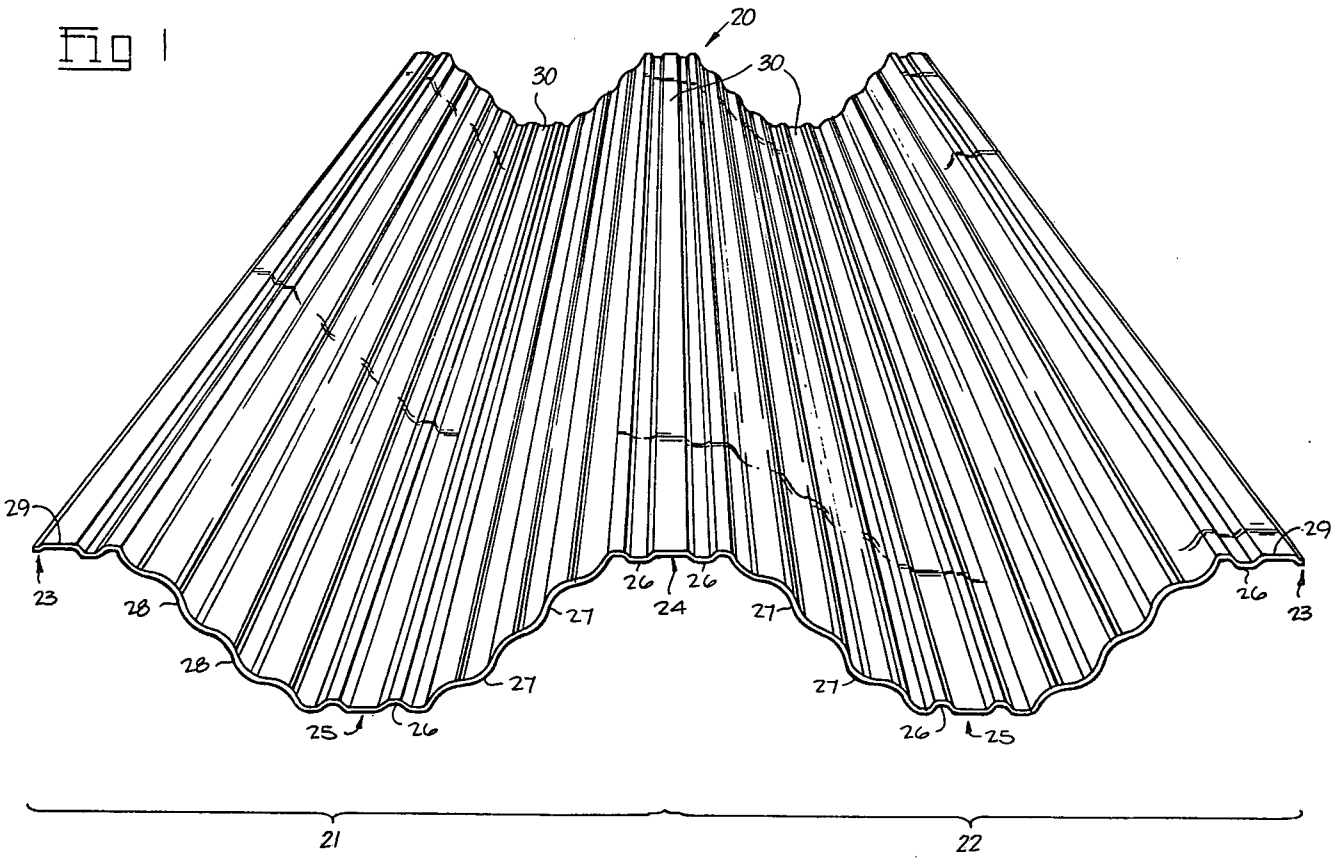
FIG. 1 is a perspective view of a corrugated metal building panel of one embodiment of this invention.
Figure 2:
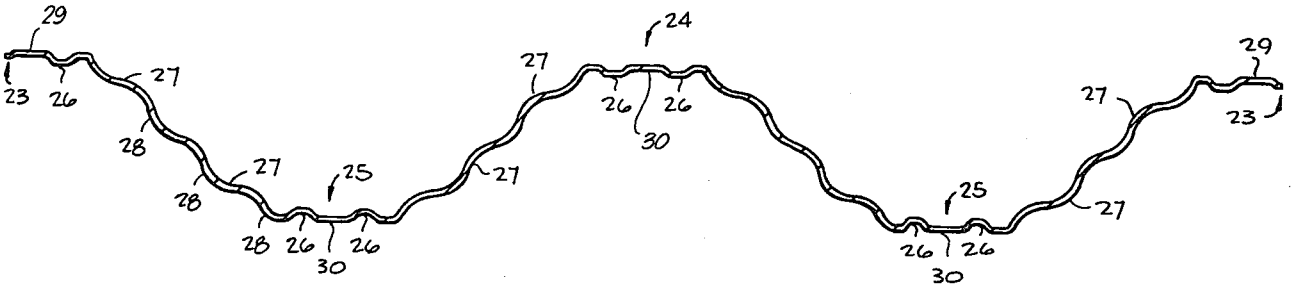
FIG. 2 is a transverse cross-section across the corrugated metal building panel of FIG. 1.

As seen in FIGS. 1 and 2, the corrugated metal building panel 20 comprises a pair of linked major generally sinusoidal waves 21, 22. The linked major waves 21, 22 provide a pair of lateral edges 23, a central crest 24 and a pair of central troughs 25. It is possible, of course, to provide a pair of crests 24 and a single central trough 25. The panel as shown in symmetrical about the mid point of central crest 24. The major waves 21, 22 are provided with discrete, spaced-apart wave-like stiffeners 26, one being disposed adjacent to, but inboard of, each of the lateral edges 23, a pair at the lateral extremities of the crest 24 and a pair at the lateral extremities of the troughs 25, and superposed minor wave-like stiffeners 27 disposed in spaced-apart pairs on opposite sides of the major waves 21, 22 at the exterior thereof. The wave-like stiffeners 27 are bounded on each side thereof by flattened portions 28 generally following the major wave form. The wave-like stiffeners 26 at the lateral edges 23 are provided with flattened lateral members 29, while the stiffeners 27 at the crest 24 and troughs 25 are connected by flattened portions 30.

The development of the profile of the corrugated metal building panel of FIG. 1 is shown in FIGS. 3 and 4 by reference to the following specific example. For a panel having a flat width of 51.181102" corresponding to a modular width of 39.37008" with a quarter wave modular width of 9.84252", the lengths of the flattened portions between the respective numbers shown on the drawings and as listed in the table are listed below:

| Distance Between | (in inches) |
|---|---|
| (1)–(2): | 0.111749 |
| (2)–(3): | 0.52492 |
| (3)–(8): | 1.070095 |
| (4)–(7): | 0.86294 |
| (5)–(6): | 0.80085 |
| (9)–(10): | 0.11538 |
| (11)–(16): | 0.36299 |
| (10)–(15): | 0.30085 |
| (13)–(14): | 0.09375 |
| (17)–(18): | 0.11538 |
| 19: | 0.25 |
| (20)–(21): | 0.1875 |
| (22)–(23): | 0.3 |
| (24)–(25): | 0.125 |
| (26)–(27): | 0.3 |
| (28)–(29): | −.1875 |
| (30)–(31): | 0.1875 |
| (31)–(36): | 1.13259 |
| (32)–(35): | 0.92549 |
| (33)–(34): | 0.06335 |
| (37)–(42): | 0.42549 |
| (38)–(41): | 0.36335 |
| (39)–(40): | 0.15625 |
| (43)–(44): | 0.11538 |
| 45: | 0.52 |

All radii for curved portions of stiffener: 0.25

All occluded angles for curved portions of stiffener: 45°. Radii for interlinked major superposed corrugations:

| | |
|---|---|
| $R_1 = 1.33382$ | $\theta_1 = 62°$ |
| $R_2 = 1.21508$ | $\theta_2 = 44°$ |
| $R_3 = 1.29008$ | $\theta_3 = 44°$ |
| $R_4 = 1.25886$ | $\theta_4 = 62°$ |
| $R_5 = 1.0375$ | $\theta_5 = 56°$ |

-continued

| | |
|---|---|
| $R_6 = 0.3375$ | $\theta_6 = 60°$ |

(ii) Description of FIGS. 5–8

Figure 5:
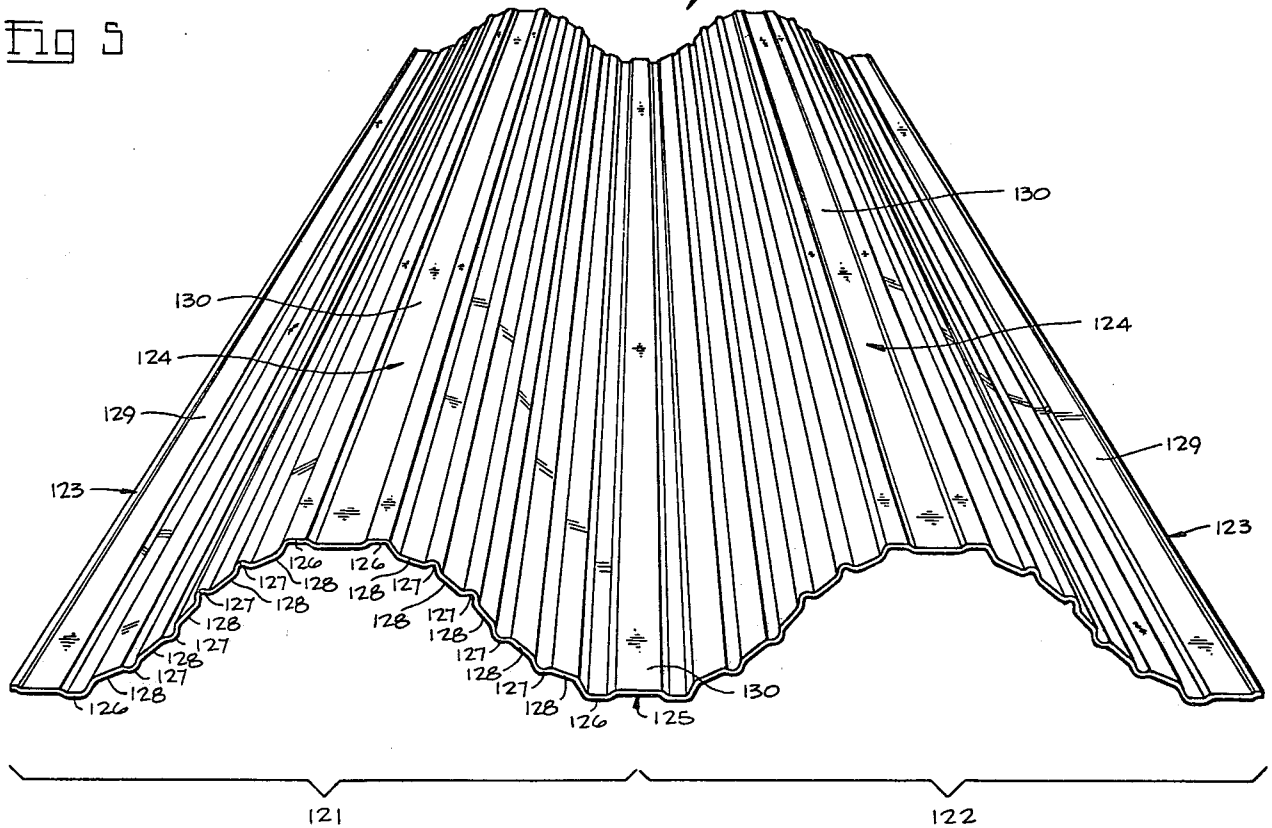
FIG. 5 is a perspective view of a corrugated metal building panel of a second embodiment of this invention.
Figure 6:
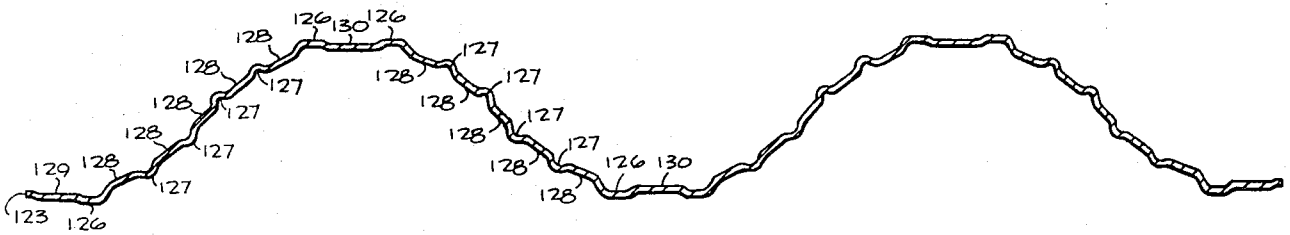
FIG. 6 is a transverse cross-section across the corrugated metal building panel of FIG. 5.

As seen in FIGS. 5 and 6, the corrugated metal building panel 120 comprises a pair of linked major waves 121, 122. The linked major waves 121, 122 provide a pair of lateral edges 123, a pair of crests 124 and a central trough 125. It is equally possible to provide a central crest 124 and a pair of troughs 125. The panel is symmetrical about the mid point of central trough 125. The major waves 121, 122 are provided with discrete, spaced-apart wave-like stiffeners 126, one being disposed adjacent to, but inboard of, each of the lateral edges 123, a pair at the lateral extremities of the crests 124 and a pair at the lateral extremities of the trough 125, and wave-like stiffeners 127 disposed in spaced-apart pairs on opposite sides of the major waves 121, 122, at the exterior thereof. The wave-like stiffeners 127 are bounded on each side thereof by flattened portions 128 generally following the major wave form. The wave-like stiffeners 126 at the lateral edges 123 are provided with flattened lateral members 129, while the stiffeners 127 at the crests 124 and trough 125 are connected by flattened portions 130.

Figure 7:
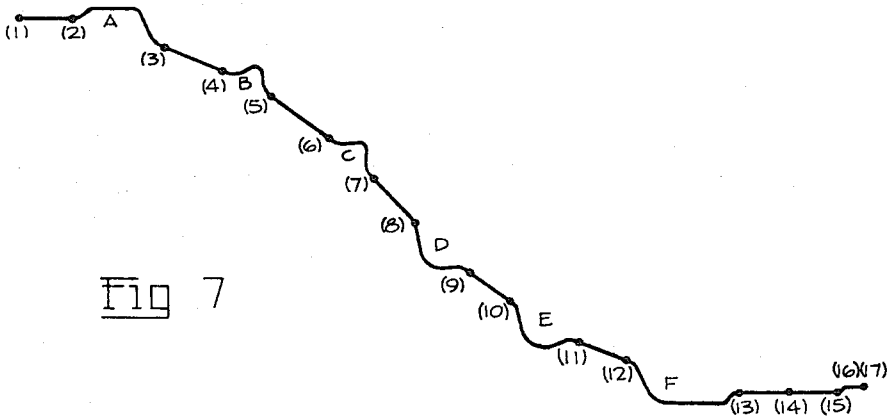
FIG. 7 is an enlarged, schematic transverse cross-section across one-half of a wave of the corrugated metal building panel of FIG. 5, depicting the generation of the profile thereof.

The development of the profile of the corrugated metal building panel of FIG. 5 is shown in FIG. 7 in conjunction with the coordinates set forth in Tables II and III. The coordinates X and Y and the length are given in inches, and the angles are measured along the horizontal and are given in degrees. The coordinates result in a panel having a width of 1000 mm.

TABLE II

| Coordinates of the Major Wave | | |
|---|---|---|
| No. | X | Y |
| 1 | 0.00000 | 6.23481 |
| 2 | 2.36725 | 5.69972 |
| 3 | 3.75179 | 4.91410 |
| 4 | 6.09073 | 2.74203 |
| 5 | 7.47527 | 1.95640 |
| 6 | 9.84252 | 1.42131 |

TABLE III

| Coordinates of the Panel | | | | |
|---|---|---|---|---|
| No. | X | Y | Length | Angle |
| 1 | 0.00000 | 6.23481 | 0.00000 | 0.00000 |
| 2 | 0.75000 | 6.23481 | 0.75000 | 0.00000 |
| 3 | 1.99473 | 5.85816 | 1.30340 | −17.25623 |
| 4 | 2.73976 | 5.55129 | 0.80201 | −21.72602 |
| 5 | 3.42906 | 5.16034 | 0.79245 | −29.56025 |
| 6 | 4.07452 | 4.66785 | 0.81189 | −37.34407 |
| 7 | 4.68292 | 4.09693 | 0.83433 | −43.17991 |
| 8 | 5.15960 | 3.55920 | 0.71859 | −48.44384 |
| 9 | 5.76800 | 2.98827 | 0.83433 | −43.17991 |
| 10 | 6.41346 | 2.49578 | 0.81189 | −37.34407 |
| 11 | 7.10276 | 2.10484 | 0.79245 | −29.56025 |
| 12 | 7.84779 | 1.80796 | 0.80201 | −21.72602 |
| 13 | 9.09252 | 1.42131 | 1.30340 | −17.25623 |
| 14 | 9.84252 | 1.42131 | 0.75000 | 0.00000 |
| 15 | 10.37377 | 1.42131 | 0.53125 | 0.00000 |
| 16 | 10.39889 | 1.51506 | 0.09706 | 75.00000 |
| 17 | 10.55919 | 1.51506 | 0.1603 | 0.00000 |
| A | 1.44862 | 6.06179 | 0.000000 | 0.00000 |
| B | 3.11009 | 5.40372 | 1.777776 | −21.72602 |
| C | 4.39061 | 4.42667 | 1.611071 | −37.34407 |
| D | 5.45191 | 3.22946 | 1.599990 | −48.44384 |
| E | 6.73243 | 2.25241 | 1.651070 | −37.34407 |
| F | 8.38390 | 1.59434 | 1.777776 | −21.72602 |

Figure 8A:
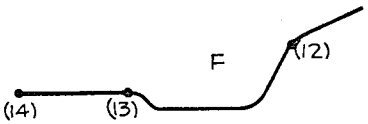
FIG. 8*a* is a schematic transverse cross-section through a stiffener element near the lateral edge of the panel of FIG. 5, showing the generation of the profile thereof.
Figure 8B:
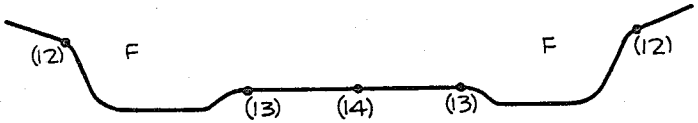
FIG. 8*b* is a schematic transverse cross-section through a "crest" or a "trough" stiffener element of the building panel of FIG. 5, showing the generation of the profile thereof.
Figure 8C:
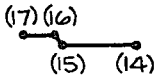
FIG. 8*c* is a schematic transverse cross-section through a lateral edge of the building panel of FIG. 5, showing the generation of the profile thereof.

The coordinates of the stiffeners at A, B and C are shown in FIGS. 8A, 8B and 8C, respectively, and are given in the following Tables IV, V and VI.

TABLE IV

| | Coordinates at A | | |
|---|---|---|---|
| No. | X | Y | Length |
| G | 0.75000 | 6.23481 | 0.00000 |
| H | 0.92678 | 6.30803 | 0.19635 |
| I | 0.94194 | 6.32320 | 0.02145 |
| J | 1.03033 | 6.35981 | 0.09817 |
| K | 1.53033 | 6.35981 | 0.50000 |
| L | 1.75999 | 6.20859 | 0.29115 |
| M | 1.85761 | 5.98162 | 0.24707 |
| N | 1.99473 | 5.84816 | 0.19635 |
| O | 0.75000 | 6.48481 | |
| P | 1.3033 | 6.23481 | |
| Q | 1.53033 | 6.10981 | |
| R | 2.08727 | 6.08040 | |

TABLE V

| | Coordinates at B | | |
|---|---|---|---|
| No. | X | Y | Length |
| G | 2.73976 | 5.55129 | 0.00000 |
| H | 2.93109 | 5.55387 | 0.19635 |
| I | 2.97689 | 5.57357 | 0.04986 |
| J | 3.20038 | 5.56059 | 0.23211 |
| K | 3.20038 | 5.56509 | 0.00000 |
| L | 3.32188 | 5.38733 | 0.21850 |
| M | 3.33451 | 5.31568 | 0.07275 |
| N | 3.42906 | 5.16034 | 0.18612 |
| O | 2.83231 | 5.78353 | |
| P | 3.07568 | 5.34392 | |
| Q | 3.07568 | 5.34392 | |
| R | 3.58071 | 5.35909 | |

TABLE VI

| | Coordinates at C | | |
|---|---|---|---|
| No. | X | Y | Length |
| G | 4.07452 | 4.66785 | 0.00000 |
| H | 4.25947 | 4.61883 | 0.19635 |
| I | 4.30871 | 4.62545 | 0.04968 |
| J | 4.51807 | 4.55518 | 0.22873 |
| K | 4.51807 | 4.55518 | 0.00000 |
| L | 4.58822 | 4.42109 | 0.15374 |
| M | 4.62379 | 4.21935 | 0.20485 |
| N | 4.68292 | 4.09693 | 0.13769 |
| O | 4.22617 | 4.86660 | |
| P | 4.34202 | 4.37768 | |
| Q | 4.34202 | 4.37768 | |
| R | 4.87000 | 4.26276 | |

Figure 9:
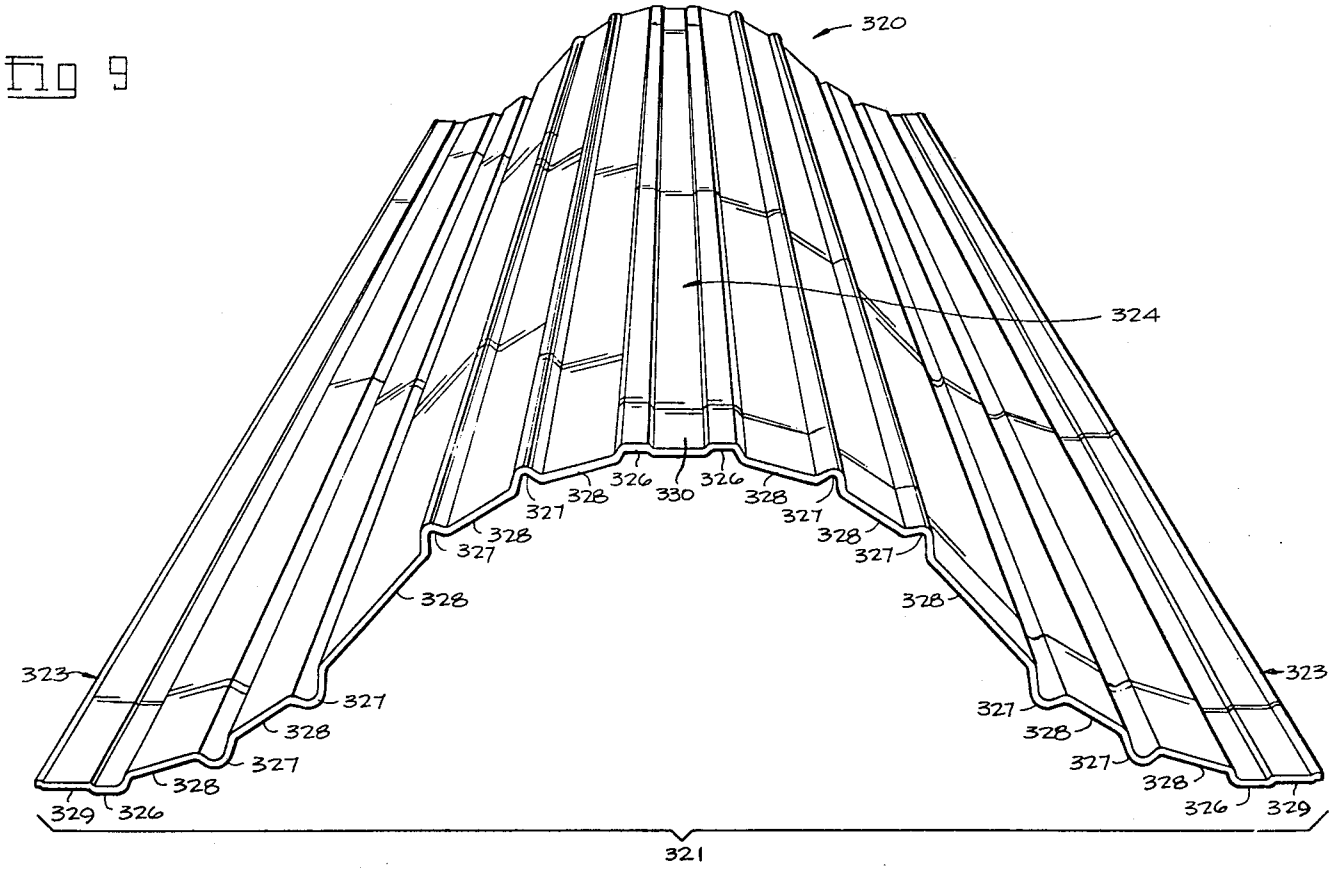
FIG. 9 is a perspective view of a corrugated metal building panel of yet another embodiment of this invention.
Figures 10, 11:
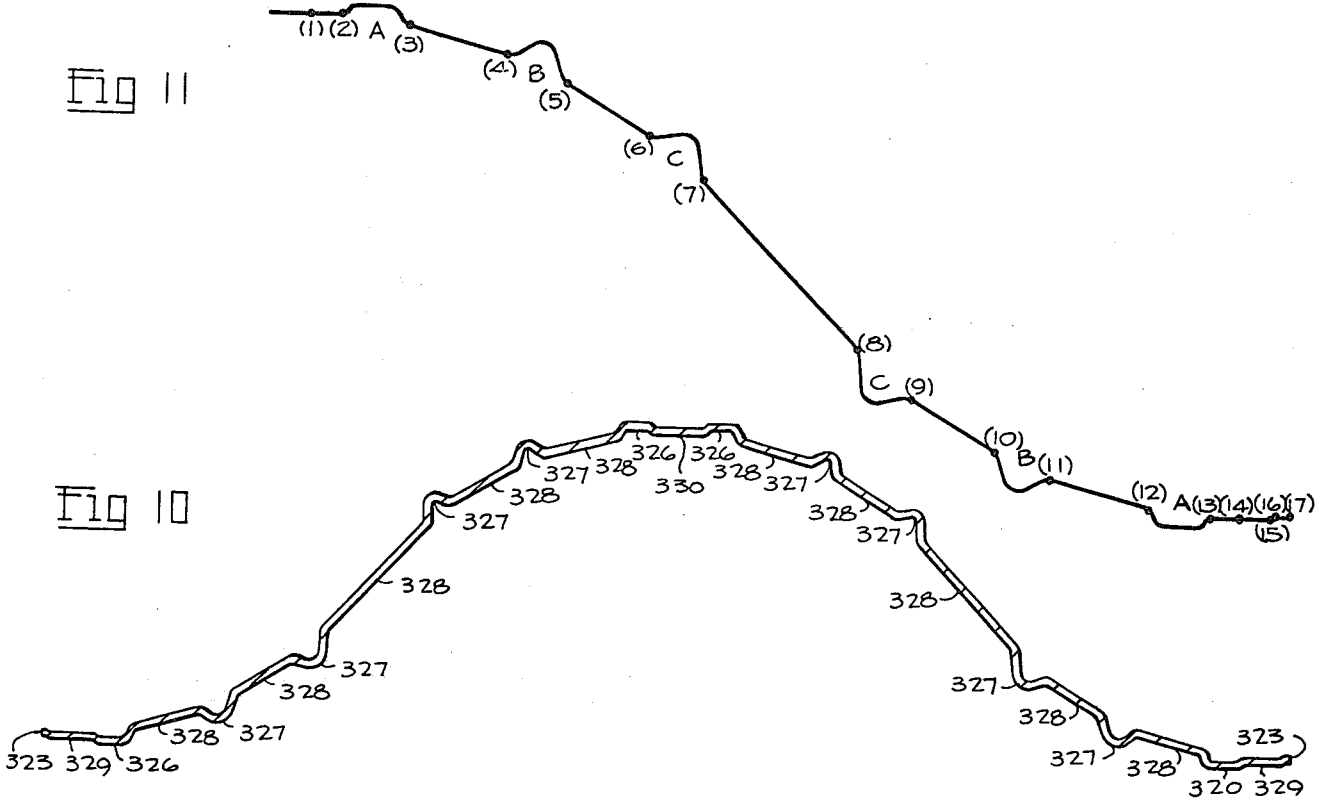
FIG. 10 is a transverse cross-section across the corrugated metal building panel of FIG. 5.
FIG. 11 is an enlarged schematic transverse cross-section through one-half of a wave of the corrugated metal building panel of FIG. 5, showing the generation of the profile thereof.

(iii) Description of FIGS. 9–11

As seen in FIGS. 9 and 10, the corrugated metal building panel 320 is in the form of one large wave 321 including a pair of lateral edges 323, and a central crest 324. It is equally possible to have a pair of lateral edges 323 and a central trough (not shown). Lateral wave-like stiffeners 326 are provided adjacent to, but inboard of, each of the lateral edges 323 and at outer edges of the central crest 324. Further wave-like stiffeners 327 are disposed in spaced-apart relation along the length of the wave 321, in pairs on opposite sides of the wave 321 at the exterior of the curvature. Wave-like stiffeners 327 are bounded on each side by flattened portions 328 while wave-like stiffeners 326 terminate in lateral members 329.

The generation of the corrugated panel profile of FIGS. 9 and 10 is shown in detail in FIG. 11, according to the coordinates given by the following Tables VII and VIII.

TABLE VII

| | Coordinates of the Wave | |
|---|---|---|
| No. | X | Y |
| 1 | 0.00000 | 12.00740 |
| 2 | 3.19180 | 11.45453 |
| 3 | 6.28126 | 10.09079 |
| 4 | 13.40378 | 3.66458 |
| 5 | 16.49324 | 2.30084 |
| 6 | 19.68504 | 1.74797 |

TABLE VIII

| | Coordinates of the Panels | | | |
|---|---|---|---|---|
| No. | X | Y | Length | Angle |
| 1 | 0.00000 | 12.00740 | 0.00000 | 0.00000 |
| 2 | 0.75000 | 12.00740 | 0.75000 | 0.00000 |
| 3 | 2.22831 | 11.72643 | 1.50477 | −10.76160 |
| 4 | 4.15528 | 11.18264 | 2.00223 | −15.75895 |
| 5 | 5.43575 | 10.61710 | 1.39980 | −23.82963 |
| 6 | 7.12677 | 9.56448 | 1.99187 | −31.90123 |
| 7 | 8.29635 | 8.56827 | 1.53634 | −40.42343 |
| 8 | 11.38869 | 5.18711 | 4.52801 | −47.55457 |
| 9 | 12.55827 | 4.19089 | 1.53634 | −40.42343 |
| 10 | 14.24929 | 3.13828 | 1.99187 | −31.90123 |
| 11 | 15.52975 | 2.57273 | 1.39980 | −23.82963 |
| 12 | 17.45673 | 2.02894 | 2.00223 | −15.75895 |
| 13 | 18.93504 | 1.74797 | 1.50477 | −10.76160 |
| 14 | 19.68504 | 1.74797 | 0.75000 | 0.00000 |
| 15 | 20.21629 | 1.74797 | 0.53125 | 0.00000 |
| 16 | 20.24754 | 1.81047 | 0.06988 | 63.43495 |
| 17 | 20.43504 | 1.81047 | 0.18750 | 0.00000 |
| A | 1.62324 | 11.89718 | 0.00000 | 0.00000 |
| B | 4.83566 | 10.99064 | 3.33788 | −15.75895 |
| C | 7.72687 | 9.19093 | 3.40559 | −31.90123 |
| D | 11.95817 | 4.56444 | 6.26964 | −47.55457 |
| E | 14.84938 | 2.76473 | 3.40559 | −31.90123 |
| F | 18.06180 | 1.85819 | 3.33788 | −15.75895 |

Figure 12:
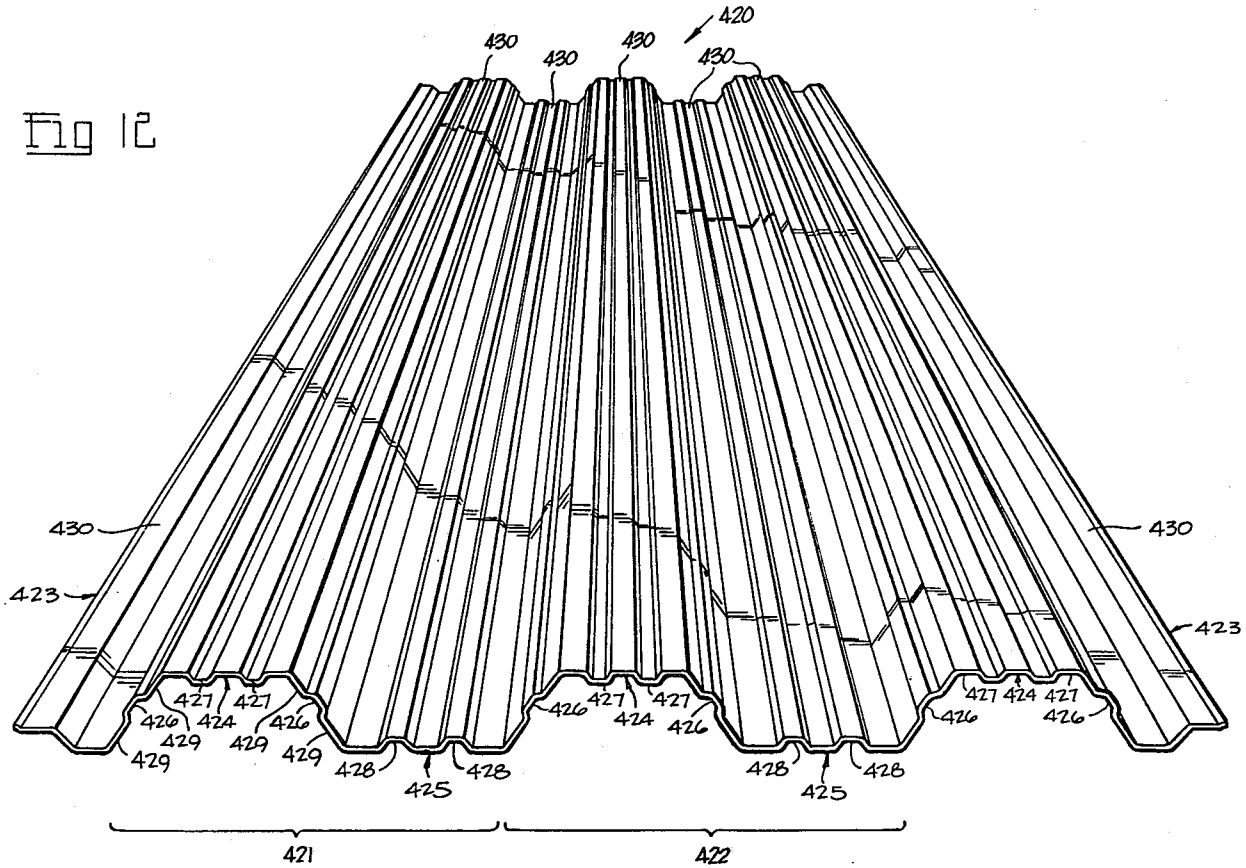
FIG. 12 is a perspective view of a corrugated metal building panel of yet another embodiment of this invention.
Figure 14:
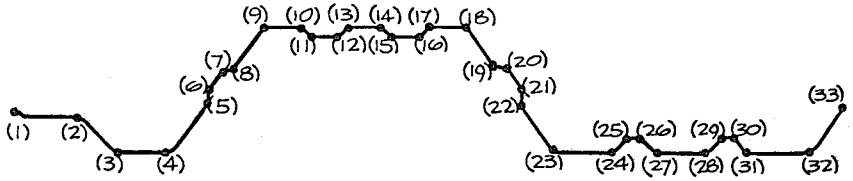
FIG. 14 is a transverse cross-section through one wave of the corrugated metal building panel of FIG. 8.
Figure 13:
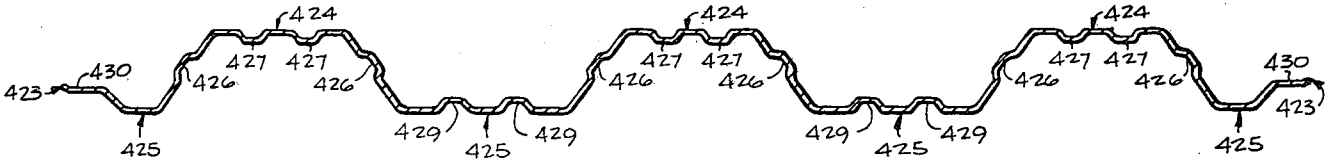
FIG. 13 is a transverse cross-section across the corrugated metal building panel of FIG. 8.
Figure 14A:
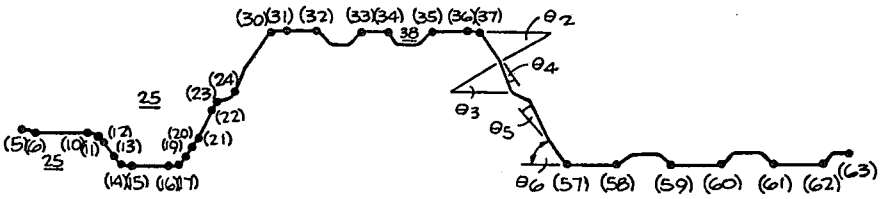
FIGS. 14*a*–14*d* are schematic cross-sections through portions of the corrugated metal building panel of FIG. 8.
Figure 14B:
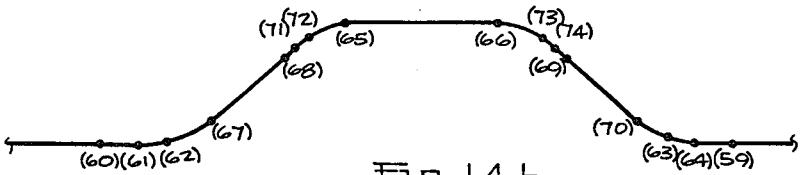
Figure 14C:
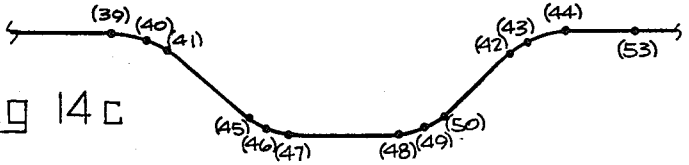
Figure 14D:
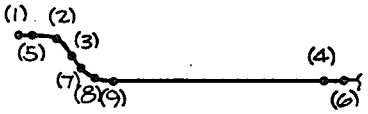

(iv) Description of FIGS. 12–13

The corrugated metal building panel of yet another embodiment of this invention is shown in FIGS. 12 and 13. As shown, the full width 1000 mm panel includes three fully linked trapezoidal major waves comprising a pair of lateral edges 423, separated by three crests 424 and two troughs 425 in alternating relation. It is equally possible to have two crests 424 and three troughs 425. The upward and downward sloping portions of the wave are each provided with a single outwardly projecting three-sided (trapezoidal) wave-like stiffener 426; each of the flat crests 424 is provided with a pair of discontinuous, three-sided (trapezoidal), spaced-apart, inwardly directed wave-like stiffener members 427; each of the flat troughs 425 is provided with a pair of discontinuous, spaced-apart, three-sided (trapezoidal), outwardly directed wave-like stiffeners 428. The trapezoidal major wave 429 between the stiffener members 427 and 426 is flat. The panel terminates in lateral flattened members 430.

For one specific variant of a panel of this embodiment of this invention which has a full width of 51.181102" and a modulus length of 39.37008" corresponding to a quarter wave length of 6.5616", the following are the dimensions along the width of the panel between the designated numbers shown on the drawing and listed below.

| (length between) | (in inches) |
|---|---|
| (1)–(2): | 0.14215 |
| (3)–(4): | 0.48865 |
| (5)–(6): | 0.67453 |

-continued

| (length between) | (in inches) |
|---|---|
| (7)-(8): | 0.437 |
| (9)-(6): | 0.46875 |
| (8)-(6): | 0.521149 |
| (6)-(16): | 2.42593 |
| (6)-(10): | 0.75972 |
| (10)-(11): | 0.11412 |
| (12)-(13): | 0.65565 |
| (14)-(15): | 0.11412 |
| (15)-(16): | 0.81298 |
| (16)-(17): | 0.14342 |
| (17)-(18): | 1.77073 |
| (19)-(20): | 0.5465 |
| (21)-(22): | 0.5405 |
| (23)-(24): | 0.175 |
| 25: | 2.51474 |
| (26)-(29): | 0.72325 |
| (27)-(28): | 0.69089 |
| (30)-(37): | 4.4432 |
| (31)-(32): | 0.81298 |
| (32)-(33): | 1.01896 |
| (33)-(34): | 0.49248 |
| (34)-(35): | 1.01876 |
| (35)-(36): | 0.81298 |
| (36)-(37): | 0.14342 |
| 38: | 0.2187 |
| (39)-(44): | 1.01896 |
| (40)-(43): | 0.81185 |
| (41)-(42): | 0.7696 |
| (45)-(50): | 0.3743 |
| (46)-(49): | 0.33211 |
| (47)-(48): | 0.125 |
| (51)-(52): | 0.08113 |
| (53)-(54): | 0.08113 |
| 55: | 0.2187 |
| (36)-(56): | 2.05756 |
| (36)-(37): | 0.14342 |
| (57)-(63): | 5.1387 |
| (56)-(58): | 0.81298 |
| (58)-(59): | 1.20646 |
| (59)-(60): | 0.81298 |
| (60)-(61): | 1.20646 |
| (61)-(62): | 0.81298 |
| (62)-(63): | 0.14342 |
| (61)-(71): | 0.25 |
| (72)-(73): | 0.4571 |
| (71)-(74): | 0.4993 |
| (74)-(64): | 0.25 |
| (60)-(59): | 1.20646 |
| (61)-(64): | 0.9993 |
| (63)-(63): | 0.9571 |
| (65)-(66): | 0.25 |
| (67)-(68): | 0.12532 |
| (69)-(70): | 0.12532 |

All the angles of the curved portions of the stiffeners are 45° and all the radii are 0.25".

The other angles and radii are as follows:

| | |
|---|---|
| $R_1 = 0.301$ | $\theta_1 = 55°$ |
| | $\theta_2 = 55°$ |
| | $\theta_3 = 68°$ |
| | $\theta_4 = 13°$ |
| | $\theta_5 = 13°$ |
| | $\theta_6 = 56°$ |

OPERATION OF PREFERRED EMBODIMENTS

A comparison of the section modulus (S), (a measure of the total strength of the panel to withstand perpendicular and vertical loads to the panel) and local buckling factor (Q), (a measure of the degree to which the strength approaches the theoretical maximum) between a corrugated panel as provided by the above-identified Lacasse Canadian Pat. No. 978,322 and the panels of FIGS. 1 and 5 of embodiments of this invention was made, with the following results.

SECTION MODULUS (S)

| Gauge | (C.P. No. 978,322) | (FIG. 1) | % Improvement | (FIG. 5) | % Improvement |
|---|---|---|---|---|---|
| 22 | 1.02 $in^3$ | 2.11 $in^3$ | 107 | — | — |
| 20 | 1.23 $in^3$ | 2.52 $in^3$ | 105 | — | — |
| 18 | 2.17 $in^3$ | 3.36 $in^3$ | 55 | — | — |
| 16 | 2.88 $in^3$ | — | — | 3.91 $in^3$ | 36 |
| 14 | 3.91 $in^3$ | — | — | 4.88 $in^3$ | 25 |

LOCAL BUCKLING FACTOR (Q)

| Gauge | (C.P. No. 978,322) | (FIG. 1) | % Improvement | (FIG. 5) | % Improvement |
|---|---|---|---|---|---|
| 22 | 0.62 | 0.94 | 52 | — | — |
| 20 | 0.63 | 0.96 | 52 | — | — |
| 18 | 0.74 | 0.96 | 30 | — | — |
| 16 | 0.81 | — | — | 0.97 | 20 |
| 14 | 0.87 | — | — | 0.98 | 13 |

The corrugated building panel of various embodiments of this invention can be used to form a building structure. The structure can include a foundation, a pair of opposed side walls, each side wall including a plurality of interconnected generally rectangular wall panels of an embodiment of this invention, and a pair of opposed end walls, each end wall including a plurality of interconnected wall panels of embodiments of this invention having arcuate upper edges, and four corner panels interconnecting adjacent wall panels. This is described in detail in the above-mentioned Lacasse Canadian patent. Since the content of this Lacasse patent is now of public record, the contents thereof are incorporated herein by reference.

The basic building panel provided with the major waves and the stiffeners may be produced on a cold roll forming machine made by B. & K. Machinery International Limited, Malton, Ontario, Canada. The wave-like stiffeners are rolled in first, and then the major waves are rolled. Such waves are made by progressive steps when the sheet travels between different sets of cooperating rolls. The last set of rolls of the machine has the exact form of the panel. Rolls may also be used to curve the sheet transversely (where required) to the desired radius.

The metal being rolled to form the corrugated metal building panel preferably is steel ranging from 14 to 22 gauge. The steel may be galvanized steel or steel to which a suitable paint, e.g., an epoxy or a urethane paint, has been applied before rolling.

SUMMARY

From the foregoing description, one skilled in the art can easily ascertain the essential characteristics of this invention, and without departing from the spirit and scope thereof, can make various changes and modifications of the invention to adapt it to varous usages and conditions. Consequently, such changes and modifications are properly, equitably, and "intended" to be, within the full range of equivalence of the following claims.

I claim:

1. A corrugated metal building panel having at least one longitudinally extending major wave disposed about a neutral axis, each such major wave being provided with a plurality of spaced-apart, discontinuous web zones, each web zone comprising a plurality of interlinked longitudinally extending wave-like stiffeners superposed on each major wave and following the general corrugated pattern of the major wave thereof, and a plurality of spaced-apart flange zones, said flange zones comprising spaced-apart, flattened areas deformed from the general corrugated pattern of the major wave of said panel and spaced-apart flange stiffeners, said flange stiffeners projecting from the exterior of the curvature of said major wave and always being directed towards the neutral axis of the panel, whereby the local buckling factor is optimized, and the section modulus and the moment of inertia are increased, and consequently the strength and rigidity of the panel is increased.

2. A corrugated metal building panel having two interlinked longitudinally extending major waves disposed about a neutral axis, each such major wave being provided with a plurality of spaced-apart, discontinuous web zones, each web zone comprising a plurality of interlinked longitudinally extending wave-like stiffeners superposed on each major wave and following the general corrugated pattern of the major wave thereof, and a plurality of spaced-apart flange zones, said flange zones comprising spaced-apart flattened areas interconnecting curved portions superposed on each major wave, said flattened areas being deformed from the general corrugated pattern of the major wave of said panel and spaced-apart flange stiffeners, said flange stiffeners projecting from the exterior of the curvature of said major waves and always being directed towards the neutral axis of the panel, whereby the local buckling factor is optimized, and the section modulus and the moment of inertia are increased, and consequently the strength and rigidity of the panel is increased.

3. The corrugated metal building panel of claim 2 wherein said flange zones comprise a pair of spaced-apart generally semi-circular stiffener elements separated by flattened stiffener elements at the troughs and the crests of the major waves.

4. The corrugated metal building panel of claim 3 wherein said flange zones also include seam stiffeners comprising a generally semi-circular seam stiffener element adjacent each lateral edge of said panel.

5. The corrugated metal building panel of claim 4 wherein the lateral edges are flattened.

6. The corrugated metal building panel of claim 5 wherein said flattened stiffener elements are longer at the troughs and at the crests than along the lateral edges of the major waves.

7. A corrugated metal building panel having two interlinked longitudinally extending major waves disposed about a neutral axis, each such major wave being provided with a plurality of spaced-apart, discontinuous web zones, each web zone comprising a plurality of interlinked longitudinally extending wave-like stiffeners superposed on each major wave and following the general corrugated pattern of the major wave thereof, and a plurality of spaced-apart flange zones, said flange zones comprising alternating spaced-apart flattened portions, said flattened areas being deformed from the general corrugated pattern of said major wave of said panel and spaced-apart generally semi-circular flange stiffeners, said flange stiffeners projecting from the exterior of the curvature of said major waves, and always being directed towards the neutral axis of the panel, whereby the local buckling factor is optimized, and the section modulus and the moment of inertia are increased, and consequently the strength and rigidity of the panel is increased.

8. The corrugated metal building panel of claim 7 where said flange zones comprise a pair of spaced-apart generally semi-circular stiffener elements separated by flattened stiffener elements at the troughs and the crests of the major waves.

9. The corrugated metal building panel of claim 8 wherein said flange zones also include seam stiffeners comprising a generally semi-circular seam stiffener element adjacent each lateral edge of said panel.

10. The corrugated metal building panel of claim 9 wherein the lateral edges are flattened.

11. The corrugated metal building panel of claim 10 wherein said flattened stiffener elements are longer at the troughs and at the crests than along the lateral edges of the major waves.

12. A corrugated metal building panel having a single longitudinally extending major wave disposed about a neutral axis, said major wave being provided with a plurality of spaced-apart, discontinuous web zones, each web zone comprising a plurality of interlinked longitudinally extending wave-like stiffeners superposed on each major wave and following the general corrugated pattern of the major wave thereof, and a plurality of spaced-apart flange zones, said flange zones comprising spaced-apart flattened portions, said flattened portions being deformed from the general corrugated pattern of the major wave of said panel, and spaced-apart generally semi-circular flange stiffeners, said flange stiffeners projecting from the exterior of the curvature of the major wave and always being directed towards the neutral axis of the panel, whereby the local buckling factor is optimized, and the section modulus and the moment of inertia are increased, and consequently the strength and rigidity of the panel is increased.

13. The corrugated metal building panel of claim 14 wherein said flange zones comprise a pair of spaced-apart generally semi-circular stiffener elements separated by flattened stiffener elements at the troughs and the crests of the major waves.

14. The corrugated metal building panel of claim 12 wherein said flange zones also include seam stiffeners comprising a generally semi-circular stiffener seam element adjacent each lateral edge of said panel.

15. The corrugated metal building panel of claim 14 wherein said flattened stiffener elements are longer in the portions interconnecting the minor corrugations than at the crest and the troughs.

16. A corrugated metal building panel having three interlinked longitudinally extending major waves disposed about a neutral axis, each such major wave being provided with a plurality of spaced-apart, discontinuous web zones, each web zone comprising a plurality of interlinked longitudinally extending wave-like stiffeners superposed on each major wave and following the general corrugated pattern of the major wave thereof, and a plurality of spaced-apart flange zones, said flange zones comprising spaced-apart flat areas interconnecting trapezoidally-shaped portions superposed on each major wave, said flattened areas being deformed from the general corrugated pattern of the major wave of said panel and spaced-apart trapezoidally-shaped flange stiffeners, said trapezoidally-shaped flange stiffeners projecting from the exterior of the curvature of said major waves and always being directed towards the neutral axis of the panel, whereby the local buckling factor is optimized, and the section modulus and the moment of inertia are increased, and consequently the strength and rigidity of the panel is increased.

17. The corrugated metal building panel of claim 16 wherein said flange zones also include seam stiffeners comprising a trapezoidally-shaped seam element adjacent each lateral edge of said panel.

18. The corrugated metal building panel of claim 17 wherein the lateral edges are flattened.

19. The corrugated metal building panel of claim 16 wherein said stiffener at each said crest comprises three interlinked trapezoidally-shaped waves, and said stiffener at each of said troughs comprise a pair of interlinked trapezoidally-shaped waves.

* * * * *